US007488209B2

(12) United States Patent
Vaccaro

(10) Patent No.: US 7,488,209 B2
(45) Date of Patent: Feb. 10, 2009

(54) COAXIAL CONNECTOR WITH INSULATOR MEMBER INCLUDING ELONGATE HOLLOW CAVITIES AND ASSOCIATED METHODS

(75) Inventor: Ronald A. Vaccaro, Hickory, NC (US)

(73) Assignee: Commscope Inc. of North Carolina, Hickory, NC (US)

( * ) Notice: Subject to any disclaimer, the term of this patent is extended or adjusted under 35 U.S.C. 154(b) by 2 days.

(21) Appl. No.: 11/764,670

(22) Filed: Jun. 18, 2007

(65) Prior Publication Data

US 2008/0311788 A1 Dec. 18, 2008

(51) Int. Cl.
*H01R 9/05* (2006.01)

(52) U.S. Cl. ..... 439/578

(58) Field of Classification Search ..... 439/578
See application file for complete search history.

(56) References Cited

U.S. PATENT DOCUMENTS 6,024,609 A 2/2000 Kooiman et al. ..... 439/675
6,217,380 B1 4/2001 Nelson et al. ..... 439/578
6,396,367 B1 5/2002 Rosenberger ..... 333/260
6,607,398 B2 8/2003 Henningsen ..... 439/578
7,011,546 B2 3/2006 Vaccaro ..... 439/580
7,104,839 B2 * 9/2006 Henningsen ..... 439/578

* cited by examiner

*Primary Examiner*—Truc T Nguyen
(74) *Attorney, Agent, or Firm*—Allen, Dyer, Doppelt, Milbrath & Gilchrist, P.A.

(57) ABSTRACT

A coaxial cable connector may include an insulator member including a forward portion, and a rearward portion extending rearwardly from the forward portion. The rearward portion may include a tubular outer conductor support portion for supporting an interior surface of the outer conductor of the end of the coaxial cable. The tubular outer conductor support portion may include a sidewall having a plurality of spaced apart hollow cavities extending therein. These cavities may advantageously provide the impedance matching and may be readily formed during manufacturing of the insulator member, such as by molding, for example. The connector may further include a housing having a forward and rearward ends and a medial portion therebetween, and a back nut threadingly engaging the rearward end of the connector housing. The insulator member may be positioned within the medial portion of the connector housing. A contact may be carried within the bore of the insulator member for connecting to the inner conductor of the end of the coaxial cable.

33 Claims, 4 Drawing Sheets

COAXIAL CONNECTOR WITH INSULATOR MEMBER INCLUDING ELONGATE HOLLOW CAVITIES AND ASSOCIATED METHODS

FIELD OF THE INVENTION

The present invention relates to the field of cables and connectors, and, more particularly, to a connector for coaxial cables and associated methods.

BACKGROUND OF THE INVENTION

Coaxial cables are widely used to carry high frequency electrical signals. Coaxial cables enjoy a relatively high bandwidth, low signal losses, are mechanically robust, and are relatively low cost. One particularly advantageous use of a coaxial cable is for connecting electronics at a cellular or wireless base station to an antenna mounted at the top of a nearby antenna tower. For example, the transmitter located in an equipment shelter may be connected to a transmit antenna supported by the antenna tower. Similarly, the receiver is also connected to its associated receiver antenna by a coaxial cable path.

A typical installation includes a relatively large diameter cable extending between the equipment shelter and the top of the antenna tower to thereby reduce signal losses. For example, CommScope, Inc. of Hickory, N.C, and the assignee of the present invention, offers its CellReach® coaxial cable for such applications. The cable includes a smooth wall outer conductor that provides superior performance to other cable types. The smooth outer wall construction also provides additional ease of attaching connector portions to the cable ends in comparison to other coaxial cable types, such as including corrugated outer conductors, for example.

A typical coaxial cable connector for such a coaxial cable includes a tubular housing or body to make electrical connection to the cable outer conductor and a center contact to make electrical connection to the inner conductor of the coaxial cable. The center contact may include a tubular rearward end to receive the inner conductor of the coaxial cable. An insulator assembly supports the center contact concentrically within the housing. The insulator assembly may typically include multiple cooperating parts.

A typical connector may also include a gripping member or ferrule that is positioned onto the end of the outer conductor and adjacent the outer insulating jacket portion of the coaxial cable. The ferrule is axially advanced into the housing as a back nut is tightened onto the rearward end of the housing. One or more O-rings may be provided to environmentally seal the connector to prevent the ingress of water, for example, into the connector.

Representative patents directed to coaxial cable connectors include U.S. Pat. No. 6,396,367 B1 to Rosenberger; U.S. Pat. No. 6,024,609 to Kooiman et al.; U.S. Pat. No. 6,607,398 B2 to Henningsen; and U.S. Pat. No. 6,217,380 B1 to Nelson et al. The entire contents of each of these patents are incorporated herein by reference.

U.S. Pat. No. 7,011,546 to Vaccaro, assigned to the assignee of the present invention and incorporated herein by reference, discloses a connector, having significant advantages over the prior art. The connector includes a housing, a back nut threadingly engaging a rearward end of the connector housing, a ferrule gripping and advancing an end of the coaxial cable into the connector housing as the back nut is tightened, and an insulator member positioned within a medial portion of the connector housing. In addition, the insulator member has a bore extending therethrough and includes a forward portion, a rearward portion, a ring portion connecting the forward and rearward portions together, and a tubular outer conductor support portion extending rearwardly from the rearward portion for supporting an interior surface of the outer conductor of the end of the coaxial cable. The ring portion may have a reduced strength portion defining a crush zone to facilitate movement of the rearward portion toward the forward portion as the back nut is tightened onto the connector housing.

CommScope has made another connector similar to the Vaccaro patent wherein the insulator member 5 is tuned to match impedances between the connector and the cable end. More particularly, as understood with reference to FIG. 1, the prior art insulator member 5 includes a forward portion 7 including a pair of longitudinal passageways therethrough 8*a*, 8*b*, for impedance matching. The insulator member 5 also comprises a tubular outer conductor support portion including a sidewall 6 initially formed to a have an inner diameter d1. In subsequent machining steps, two additional enlarged diameters d2, d3 are formed in the sidewall 6 to tune the impedance. In other words, after the initial molding to form the insulator member 5, the two enlarged diameters d2, d3 are created by additional machining steps. These extra manufacturing steps may increase the cost and/or complexity of the manufacturing.

SUMMARY OF THE INVENTION

In view of the foregoing background, it is therefore an object of the invention to provide a coaxial connector having an insulator member that may be readily manufactured and that effectively matches the impedance between the coaxial cable end and the connector.

These and other objects, features and advantages in accordance with the present invention are provided by a coaxial cable connector comprising an insulator member including a forward portion, and a rearward portion extending rearwardly from the forward portion. The rearward portion may comprise a tubular outer conductor support portion for supporting an interior surface of the outer conductor of the end of the coaxial cable. In addition, the tubular outer conductor support portion may comprise a sidewall having a plurality of spaced apart hollow cavities extending therein. These cavities may advantageously provide the impedance matching and may be readily formed during manufacturing of the insulator member, such as by molding, for example.

The connector may further include a housing having forward and rearward ends and a medial portion therebetween, and a back nut threadingly engaging the rearward end of the connector housing. The insulator member may be positioned within the medial portion of the connector housing. A contact may be carried within the bore of the insulator member for connecting to the inner conductor of the end of the coaxial cable.

The rearward portion of the insulator member may further comprise a rearward disk portion coupling the tubular outer conductor support portion to the forward portion and having a plurality of openings extending therethrough aligned with and in communication with respective hollow cavities of the tubular outer conductor support portion. In some embodiments, each of the plurality of elongate hollow cavities may extend only partway into the sidewall of the tubular outer conductor support portion. Each of the hollow cavities may have a cylindrical shape, for ease of molding, for example.

The insulator member may have a longitudinal axis, and the hollow cavities may be elongate hollow cavities extending generally parallel with the longitudinal axis of the insulator member. The elongate hollow cavities may be equally angularly spaced about the longitudinal axis of the insulator member. In addition, the sidewall of the tubular outer conductor support portion may have a constant uniform inner diameter and/or a constant uniform outer diameter.

The connector may further comprise a ferrule gripping an end of the coaxial cable for advancing the end of the coaxial cable into the connector housing as the back nut is tightened onto rearward end of the connector housing. The forward and rearward portions of the insulator member along with the plurality of hollow cavities may be integrally molded as a monolithic unit. The forward portion of the insulator member may comprise a forward disk portion, and a ring portion coupling the forward disk portion to the rearward portion.

A method aspect is for making a coaxial cable connector. The method may comprise providing a connector housing, and forming an insulator member for positioning within the connector housing. The insulator may comprise a forward portion, and a rearward portion extending rearwardly from the forward portion and comprising a tubular outer conductor support portion for supporting an interior surface of the outer conductor of the end of the coaxial cable. Moreover, the tubular outer conductor support portion may comprise a sidewall having a plurality of spaced apart hollow cavities extending therein.

DETAILED DESCRIPTION OF THE PREFERRED EMBODIMENTS

The present invention will now be described more fully hereinafter with reference to the accompanying drawing, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
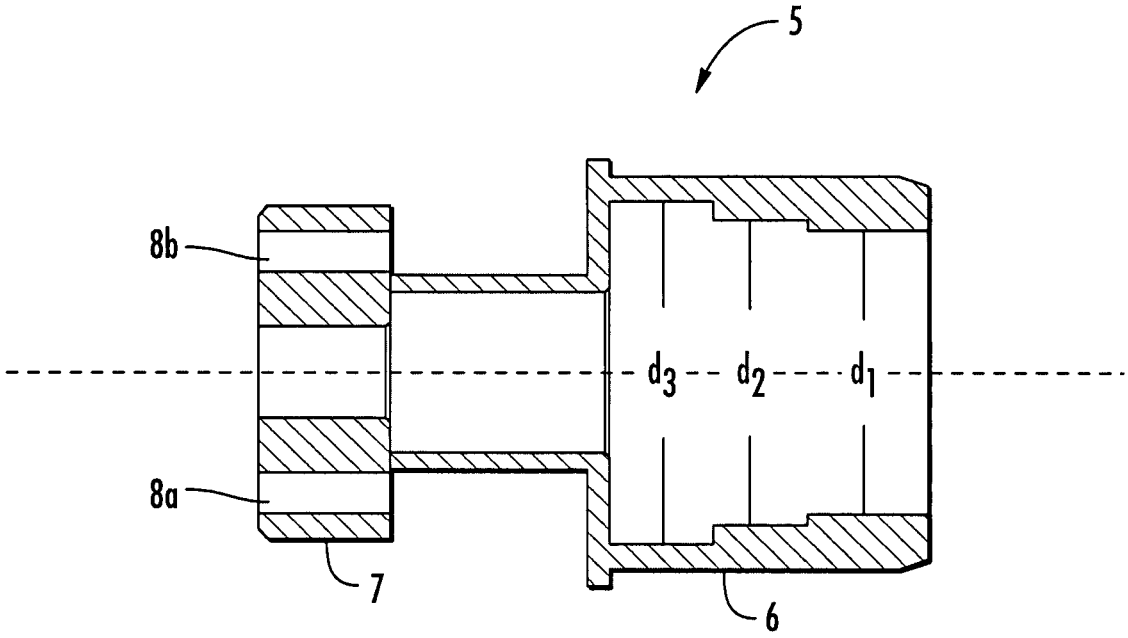
FIG. 1 PRIOR ART
FIG. 1 is a cross-sectional view of an insulator member for a coaxial cable connector as in the prior art.
Figure 2:
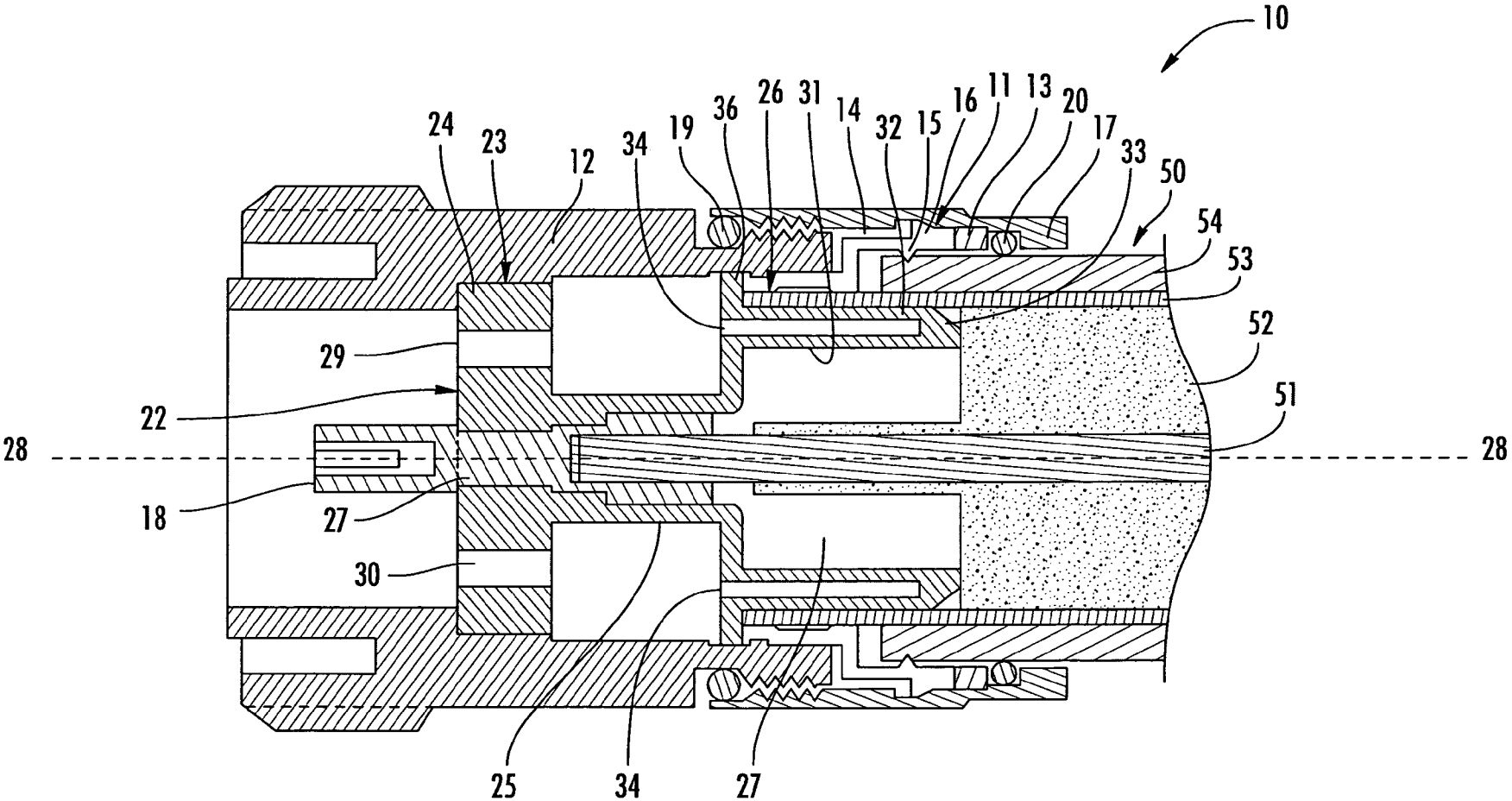
FIG. 2 is a cross-sectional view of a coaxial cable connector installed on the end of a coaxial cable in accordance with the present invention.

Referring initially to FIG. 2, the coaxial cable connector 10 in accordance with the present invention is now described. The connector 10 is installed onto the end of a coaxial cable 50 that illustratively includes an inner conductor 51, a dielectric layer 52 surrounding the inner conductor, an outer conductor 53 surrounding the dielectric layer, and an outer insulating jacket 54 surrounding the outer conductor. In preparation for use with the connector 10, portions of the dielectric layer 52 and the outer insulating jacket 54 are removed so that the inner conductor 51 extends axially outwardly beyond the end of the outer conductor 53, and the inner surface of the outer conductor 53 is exposed.

A ferrule 11 is positioned over the end of the outer conductor 53 and adjacent portions of the jacket 54 of the cable 50. The ferrule 11 includes a supporting band portion 13 and plurality of circumferentially spaced apart gripping members 14 carried by the supporting band portion. The ferrule 11 also includes inner tabs 15 and outer tabs 16 carried by each gripping member 14 as shown in the illustrated embodiment. The forward ends of the gripping members 14 wedge tightly between the outer conductor 53 and interior portions of the housing 12. The ferrule 11 may preferably be formed as single monolithic unit to thereby reduce the number of connector components and thereby reduce the overall cost of the connector 10.

The connector 10 includes an internally threaded back nut 17 threaded onto the externally threaded rearward end of the connector housing 12. As the back nut 17 is tightened, the end of the inner conductor 51 is positioned further into a rearward end of a center contact 18. The ferrule 11 is also compressed into secure engagement between the outer conductor 53 and the adjacent interior portions of the housing 12 as will be appreciated by those skilled in the art. A forward O-ring 19 and a rearward O-ring 20 are provided to seal respective forward and rearward interfaces adjacent the back nut 17 and prevent moisture ingress.

Figure 3:
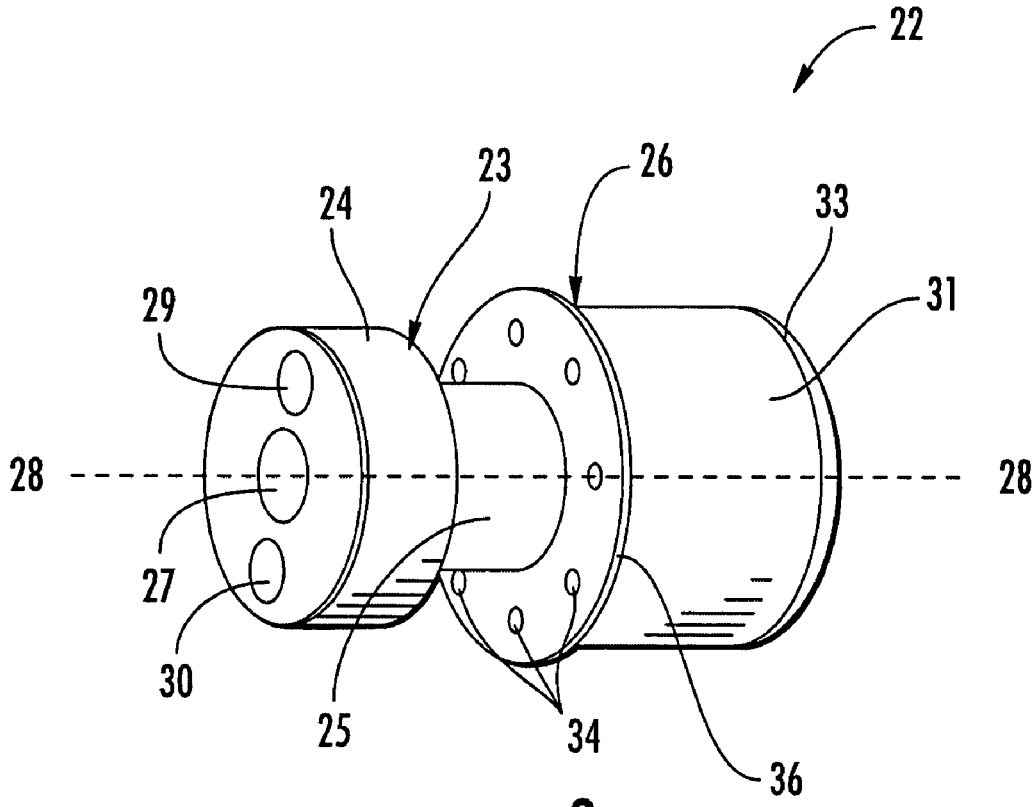
FIG. 3 is a perspective view of the insulator member of the coaxial cable connector as shown in FIG. 2.
Figure 4:
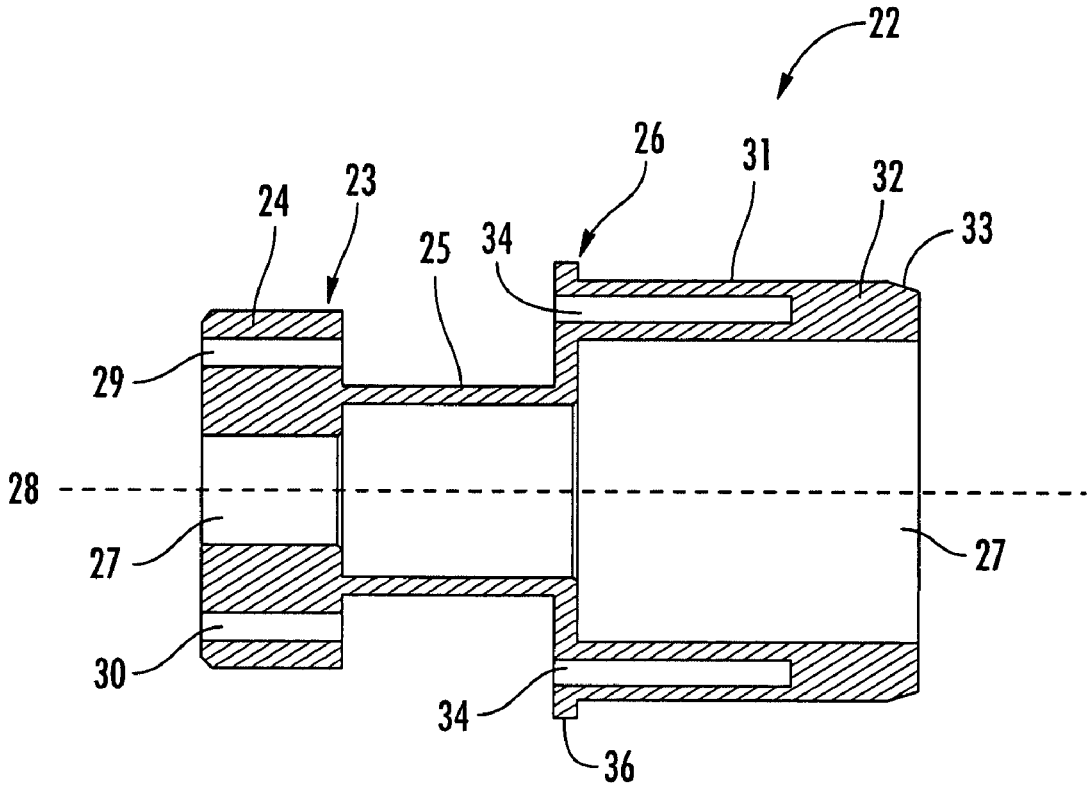
FIG. 4 is a cross-sectional view of the insulator member of the coaxial cable connector as shown in FIG. 2.

Referring now additionally to FIGS. 3 and 4, further advantageous features of the connector 10 are now described. An insulator member 22 illustratively supports the center contact 18 in the housing 12. The insulator member 22 includes a forward portion 23 that has a forward disk portion 24 and a ring portion 25 that couples the forward disk portion with a rearward portion 26. A central bore 27 runs longitudinally through both the forward and rearward portion 23, 26 defining a longitudinal axis 28 through the insulator member 22. In addition, the forward disk portion 24 has a pair of longitudinal passageways 29, 30 on either side of the central bore 25 that extends therethrough. The passageways 29, 30 create air spaces for impedance matching.

The rearward portion 26 includes a tubular outer conductor support portion 31 that supports an interior surface of the outer conductor 53 of the end of the coaxial cable 50. The tubular outer conductor support portion 31 comprises a sidewall 32 having a substantially tubular shape with a chamfered rearward end 33. In addition, the sidewall 32 includes a plurality of angularly spaced apart hollow elongate cavities 34 extending therein. Each of these cavities 34 is generally parallel with the longitudinal axis 28 of the insulator member 22, and extends only partway into sidewall. Of course, in other embodiments the cavities 34 could be through-holes, for example. These cavities 34 advantageously provide additional impedance matching capability and can be readily formed during manufacturing of the insulator member 22, such as by molding, for example. The rearward portion 26 also includes a rearward disk portion 36 coupling the tubular outer conductor support portion 31 to the ring portion 25 of the forward portion 23 of the insulator member. This rearward disk portion 36 also has openings aligned with the cavities 34.

The insulator member 22 may also be desirably formed as a single monolithic unit to reduce the number of components and thereby reduce the cost of the connector 10. For example, the insulator member 22 may be molded from plastic as will be appreciated by those skilled in the art.

The connector 10 is illustratively in form of a female DIN connector. The features and advantages of the connector 10, as described herein, may be used in other connector types, such as N-female, N-male, and DIN-male types of connectors, for example, as will be appreciated by those skilled in the art. The connector 10 may also be suitable for a ⅞-inch coaxial cable of the type commonly used for wireless base stations, for example. Such applications are also described in U.S. Pat. No. 6,217,380 assigned to the assignee of the present invention and the entire disclosure of which is incorporated herein by reference. The cable may be smooth wall or corrugated wall, for example. Other sizes and types of coaxial cable, and other applications are also contemplated by the invention.

One method aspect is for making the coaxial cable connector 10. The method may comprise providing a connector housing 12, and forming an insulator member 22 for positioning within the connector housing. The insulator member 22 may comprise a forward portion 23, and a rearward portion 26 extending rearwardly from the forward portion and comprising a tubular outer conductor support portion 31 for supporting an inner surface of the outer conductor 53 of the end of the coaxial cable 50. Moreover, the tubular outer conductor support portion 31 may comprise a sidewall 32 having a plurality of spaced apart hollow cavities 34 extending therein.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included.

That which is claimed is:

1. A coaxial cable connector for a coaxial cable comprising a center conductor, a dielectric layer surrounding the center conductor, and an outer conductor surrounding the dielectric layer, the coaxial cable connector comprising:

a connector housing having a forward and rearward ends and a medial portion therebetween;

a back nut threadingly engaging the rearward end of said connector housing;

an insulator member positioned within the medial portion of said connector housing, said insulator member having a bore extending therethrough and comprising a forward portion, and a rearward portion extending rearwardly from said forward portion and comprising a tubular outer conductor support portion for supporting an interior surface of the outer conductor of the end of the coaxial cable, said tubular outer conductor support portion comprising a sidewall having a plurality of spaced apart hollow cavities extending therein; and a contact carried within the bore of said insulator member for connecting to the inner conductor of the end of the coaxial cable.

2. A coaxial cable connector according to claim 1 wherein said rearward portion further comprises a rearward disk portion coupling said tubular outer conductor support portion to said forward portion and having a plurality of openings extending therethrough aligned with and in communication with respective hollow cavities of said tubular outer conductor support portion.

3. A coaxial cable connector according to claim 1 wherein each of said plurality of elongate hollow cavities extends only partway into said sidewall.

4. A coaxial cable connector according to claim 1 wherein each of said plurality of hollow cavities has a cylindrical shape.

5. A coaxial cable connector according to claim 1 wherein said insulator member has a longitudinal axis; and wherein each of said plurality of spaced apart hollow cavities comprises an elongate hollow cavity extending generally parallel with the longitudinal axis of said insulator member.

6. A coaxial cable connector according to claim 5 wherein said plurality of elongate hollow cavities is equally angularly spaced about the longitudinal axis of said insulator member.

7. A coaxial cable connector according to claim 1 wherein said sidewall of said tubular outer conductor support portion has a constant uniform inner diameter.

8. A coaxial cable connector according to claim 1 wherein said sidewall of said tubular outer conductor support portion has a constant uniform outer diameter.

9. A coaxial cable connector according to claim 1 further comprising a ferrule gripping an end of the coaxial cable for advancing the end of the coaxial cable into said connector housing as said back nut is tightened onto rearward end of said connector housing.

10. A coaxial cable connector according to claim 1 wherein said forward and rearward portions of said insulator member along with said plurality of hollow cavities are integrally molded as a monolithic unit.

11. A coaxial cable connector according to claim 1 wherein said forward portion of said insulator member comprises:

a forward disk portion; and a ring portion coupling said forward disk portion to said rearward portion.

12. A coaxial cable connector for a coaxial cable comprising a center conductor, a dielectric layer surrounding the center conductor, and an outer conductor surrounding the dielectric layer, the coaxial cable connector comprising:

a connector housing having a forward and rearward ends and a medial portion therebetween;

a back nut threadingly engaging the rearward end of said connector housing;

an insulator member positioned within the medial portion of said connector housing defining a longitudinal axis and having a bore extending therethrough along the longitudinal axis, said insulator member comprising a forward portion, and a rearward portion extending rearwardly from said forward portion and comprising a tubular outer conductor support portion for supporting an interior surface of the outer conductor of the end of the coaxial cable, said tubular outer conductor support portion comprising a sidewall having a plurality of spaced apart hollow elongate cavities extending therein generally parallel with the longitudinal axis of said insulator member and extending only partway into said sidewall; and a contact carried by said insulator member for connecting to the inner conductor of the end of the coaxial cable.

13. A coaxial cable connector according to claim 12 wherein said plurality of elongate hollow cavities is equally angularly spaced about the longitudinal axis of said insulator member.

14. A coaxial cable connector according to claim 12 wherein said rearward portion further comprises a rearward disk portion coupling said tubular outer conductor support portion to said forward portion and having a plurality of openings extending therethrough aligned with and in communication with respective hollow elongate cavities of said tubular outer conductor support portion.

15. A coaxial cable connector according to claim 12 wherein each of said plurality of hollow elongate cavities has a cylindrical shape.

16. A coaxial cable connector according to claim 12 wherein said sidewall of said tubular outer conductor support portion has a constant uniform inner diameter and a constant uniform outer diameter.

17. A coaxial cable connector according to claim 12 wherein said forward and rearward portions of said insulator member along with said plurality of hollow cavities are integrally molded as a monolithic unit.

18. A coaxial cable connector for a coaxial cable comprising a center conductor, a dielectric layer surrounding the center conductor, and an outer conductor surrounding the dielectric layer, the coaxial cable connector comprising:

a connector housing; and an insulator member positioned within said connector housing and comprising a forward portion, and a rearward portion extending rearwardly from said forward portion and comprising a tubular outer conductor support portion for supporting an interior surface of the outer conductor of the end of the coaxial cable, said tubular outer conductor support portion comprising a sidewall having a plurality of spaced apart hollow cavities extending therein.

19. A coaxial cable connector according to claim 18 wherein said rearward portion further comprises a rearward disk portion coupling said tubular outer conductor support portion to said forward portion and having a plurality of openings extending therethrough aligned with and in communication with respective hollow cavities of said tubular outer conductor support portion.

20. A coaxial cable connector according to claim 18 wherein each of said plurality of elongate hollow cavities extends only partway into said sidewall.

21. A coaxial cable connector according to claim 18 wherein each of said plurality of hollow cavities has a cylindrical shape.

22. A coaxial cable connector according to claim 18 wherein said insulator member has a longitudinal axis; and wherein each of said plurality of spaced apart hollow cavities comprises an elongate hollow cavity extending generally parallel with the longitudinal axis of said insulator member.

23. A coaxial cable connector according to claim 22 wherein said plurality of elongate hollow cavities is equally angularly spaced about the longitudinal axis of said insulator member.

24. A coaxial cable connector according to claim 18 wherein said sidewall of said tubular outer conductor support portion has a constant uniform inner diameter and a constant uniform outer diameter.

25. A coaxial cable connector according to claim 18 wherein said forward and rearward portions of said insulator member along with said plurality of hollow cavities are integrally molded as a monolithic unit.

26. A method for making a coaxial cable connector for a coaxial cable comprising a center conductor, a dielectric layer surrounding the center conductor, and an outer conductor surrounding the dielectric layer, the method comprising:

providing a connector housing; and forming an insulator member for positioning within the connector housing and comprising a forward portion, and a rearward portion extending rearwardly from the forward portion and comprising a tubular outer conductor support portion for supporting an interior surface of the outer conductor of the end of the coaxial cable, the tubular outer conductor support portion comprising a sidewall having a plurality of spaced apart hollow cavities extending therein.

27. A method according to claim 26 wherein forming the insulator member comprises integrally molding the forward and rearward portions of the insulator member along with the plurality of hollow cavities as a monolithic unit.

28. A method according to claim 26 wherein the rearward portion further comprises a rearward disk portion coupling the tubular outer conductor support portion to the forward portion and having a plurality of openings extending therethrough aligned with and in communication with respective hollow cavities of the tubular outer conductor support portion.

29. A method according to claim 26 wherein each of the plurality of elongate hollow cavities extends only partway into the sidewall.

30. A method according to claim 26 wherein each of the plurality of hollow cavities has a cylindrical shape.

31. A method according to claim 26 wherein the insulator member has a longitudinal axis; and wherein each of the plurality of spaced apart hollow cavities comprises an elongate hollow cavity extending generally parallel with the longitudinal axis of the insulator member.

32. A method according to claim 31 wherein the plurality of elongate hollow cavities are equally angularly spaced about the longitudinal axis of the insulator member.

33. A method according to claim 26 wherein the sidewall of the tubular outer conductor support portion has a constant uniform inner diameter and a constant uniform outer diameter.

* * * * *